US005862792A

United States Patent [19]

Paul et al.

[11] Patent Number: 5,862,792

[45] Date of Patent: Jan. 26, 1999

[54] SELF-INJECTION SYSTEM

[76] Inventors: Marius A. Paul; Ana Paul, both of 1120 E. Elm Ave., Fullerton, Calif. 92631

[21] Appl. No.: 909,164

[22] Filed: Aug. 11, 1997

Related U.S. Application Data

[63] Continuation-in-part of Ser. No. 607,945, Feb. 28, 1996, Pat. No. 5,685,272.

[51] Int. Cl.[6] ..... F02M 37/04

[52] U.S. Cl. ..... 123/446; 123/472

[58] Field of Search ..... 123/446, 447, 123/472, 509, 432, 590; 239/533.12

[56] References Cited

U.S. PATENT DOCUMENTS

| | | | |
|---|---|---|---|
| 4,633,830 | 1/1987 | Oshima et al. | 123/472 |
| 4,917,352 | 4/1990 | Hauet | 123/472 |
| 4,945,877 | 8/1990 | Zeigler | 123/472 |
| 5,109,823 | 5/1992 | Yokoyama | 123/472 |
| 5,109,824 | 5/1992 | Okamoto | 123/472 |
| 5,181,494 | 1/1993 | Ausman | 123/446 |
| 5,533,482 | 7/1996 | Naitoh et al. | 123/472 |
| 5,685,272 | 11/1997 | Paul | 123/446 |

*Primary Examiner*—Carl S. Miller
*Attorney, Agent, or Firm*—Bielen, Peterson & Lampe

[57] ABSTRACT

A fuel injection system for an engine having a combustion chamber, the fuel injection system in a preferred embodiment having a hydraulic actuator module with a hydraulic actuating fluid for activating a fuel injection piston with fluid in an actuating chamber of an injector defined in part by a large head, amplifying piston connected to the fuel injection piston the actuating fluid communicating with a hydraulic pulse pump driven by the pressure in the combustion chamber, the injector including a sub-module to provide a multi-pulse discharge to fuel and a discharge nozzle having an orifice with a poppet valve having a structure to provide a pulsed, conical, swirling spray of fuel.

15 Claims, 6 Drawing Sheets

SELF-INJECTION SYSTEM

The invention is a continuation-in-part prior application, "Self Injection Systems", Ser. No. 08/607,945 filed Feb. 28, 1996, now U.S. Pat. No. 5,685,272, issued Nov. 11, 1997.

BACKGROUND OF THE INVENTION

This invention relates to general categories of an injection system which have common configurations and structural arrangements, are able to operate using the "self injection" concept, and/or the "common rail" concept, and the "multiple injection per cycle concept", particularly using the concept of "self-induced pulsations".

A general attribute that is characteristic of the embodiment using "self-induced multiple injections", is the ability to be associated with and incorporated into any existing or new injection systems.

This general attribute is enhanced by the modular structure of the preferred implementation which can be flexibly configured for different injection systems, depending on particular applications.

SUMMARY OF THE INVENTION

A first category for implementation of the invention relates to the most general characteristic of a common structure which can be incorporated into a system based on a self injection system and/or common rail system, with minor modifications to adapt to specific engine configurations. "Self-induced, multiple injections" can be generated in both types of systems, using conventional injectors or new concepts, such as those set forth in our referenced application.

A second category for implementation of the invention is a specific configuration of a self induced, multiple injection system associated and integrated with any conventional injection system without any modifications to the existing engines.

The embodiments of the first category are electronically controlled without mechanical actuation, and, the embodiments of the second category are mechanically actuated and controlled.

In the first embodiment, the working injection system as described in the parent application "Self Injection System," relates to a fuel injection system suitable for internal combustion engines, wherein the developed pressure within the compression and combustion chamber is utilized to generate the amplified fuel pressure for the injection process.

The new improvement introduces a number of novel features and advantages:

The most important advantage introduced by these improvements, is the separation between the hydraulic actuation module and the high pressure injection module. This enables independent control of all the parameters of the injection mixture formation and finally the perfect clean combustion.

Features of the improved injection system include an hydraulic cylinder actuating module, with a slidable amplifier piston that is provided with an electronic/hydraulic control valve system having a commanding plunger that is "hydraulically unbalanced". This module controls the access to the pressurized actuation fluid over the hydraulically unbalanced plunger and is able to control the opening to the source of the pressurized fluid at the start of the injection. The access opening remains open along all the expansion stroke thereby recovering the energy dissipated in the injection time.

The high pressure injection module is provided with an electro hydraulic valve, which controls the general pressurization and the timing of the "sharp cut" of the pressure profile at the end of the injection. The same high pressure injection module is preferably provided with the self-induced, multiple injection, sub-module.

Finally, individual modules of the modularized self injection system described above can be associated with any existing injectors or new injectors.

In the type of injection system specific to the self injection concept, the compression and combustion pressure of gases in the combustion chamber of the engine on which the injector is mounted provide the driving pressure for pressurizing the actuation fluid (engine oil or fuel). In this manner, the pressure of the injection fuel, as amplified 10–15 times by the hydraulic actuator, profiles the pressure developed in the combustion chamber.

The new injection system utilizes directly the effect of the pressure evolution of the thermal cycle, to induce in the fuel injection process, a proportional, triangular, evolutive pressure, which is the absolute ideal for formation of an air-fuel mixture for a perfect clean combustion process.

A second embodiment of this injection system in the first category is a working injection system based on the common rail concept in which the hydraulic pressure source is a medium pressure fuel pump (approx. 4000 psi); This configuration is provided with a balanced electro-hydraulic valve and a bypass discharge communication between the hydraulic actuator module and the high pressure injection module.

The new modularized injection system is preferably associated with a new poppet valve injection nozzle, which generates a conic shaped injection spray equivalent to a nozzle with an infinite number of holes and a high speed vortex generator for spinning the fuel, which generates high intensity centrifugal accelerations of the fuel molecules, producing an explosive dispersion of the fuel and air mixture.

This type of fuel injector generates a total homogenization of the fuel-air mixture and is a complete departure from the non-homogenous fuel mixture of the typical diesel, which is responsible for the usual emission of nox and particulate matter.

A special category, including an alternate embodiment of the self injection system described above is designed to enable a very large quantity of fuel to be injected in a very short time for highly supercharged engines.

The primary characteristic of this category is an additional self-activated, fluid by-pass system which can increase significantly the transfer capacity of actuation fluid producing very strong injection impulses in an extremely short angular time.

All of these injection systems are electronically controlled, based on an optimized map of operations for all the regimes of power, torque, rotation speed and level of supercharging. The systems utilize modern smart sensors for adjusting operating parameters from a central control module. An important feature of the preferred embodiments utilizing the self injection concept is the permanent self injection cycle profile that follows the combustion process, cycle by cycle, enabling a one cycle time of correction reaction by the electronic control module for all potential deviations from optimum conditions.

Since the regulation of any and all the cycle parameters is primarily automatic, the control function of the electronic control module is easily extended over all conditions for each injector. The capability of individual self-control of the injection process for each cylinder enables the system to self-diagnose and to equalize all the factors in an absolute regime of cooperative operation. This results in a self-regulating system for uniform operation of each injector in the entire engine system.

By appropriate modification in the design of the self injection system, the system can also be extended to spark ignited engines enabling operation with lean and ultra lean fuel mixtures, resulting in a pressurized charge without any energy loss with a termination having a sharp cut of the injection from a maximum injection pressure can be contemporaneous with maximum combustion pressure. In this way the quality of atomization is conserved from the beginning to the end of the injection.

DETAILED DESCRIPTION OF THE PREFERRED EMBODIMENTS

Figure 1:
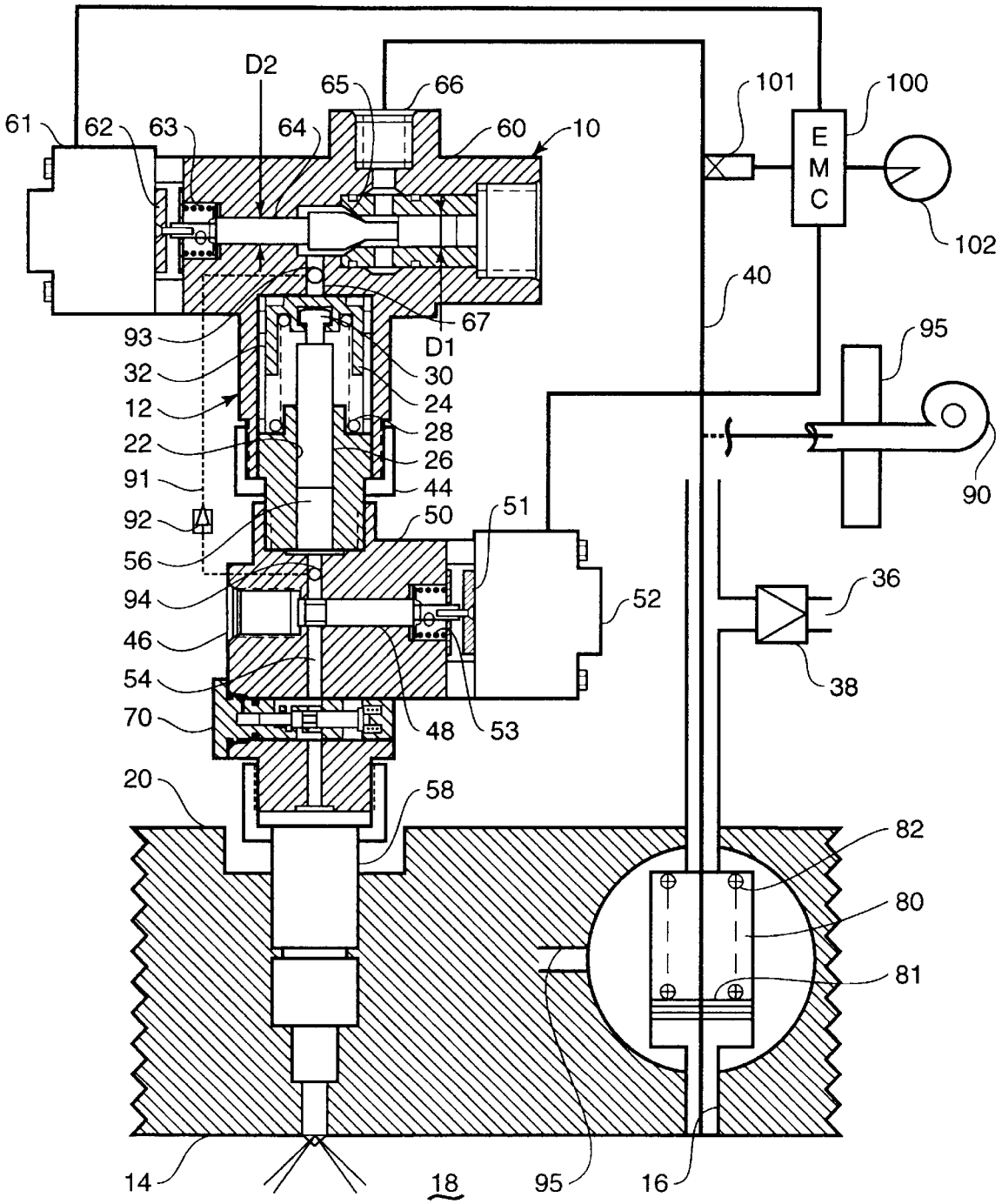
FIG. 1 is a schematic view, partially in cross section of a first embodiment of a fuel injection system utilizing the self injection concept with an alternate common rail and a multiple injection capability.
Figure 2:
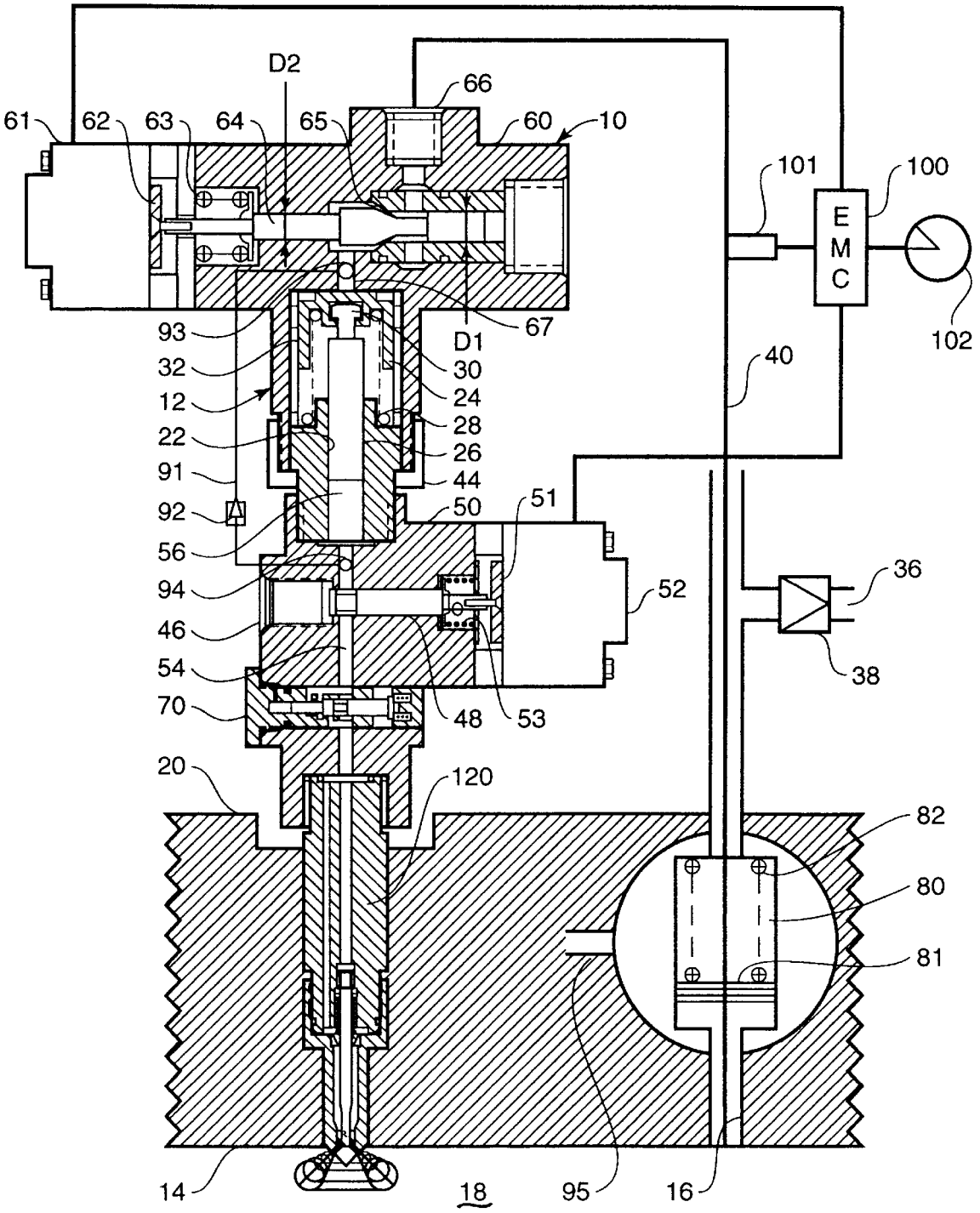
FIG. 2 is a similar injection system to that of FIG. 1 associated with a modified injector provided with a poppet valve nozzle.

The preferred embodiments of the fuel injection system of this invention are shown in FIGS. 1 and 2. The fuel injection system of FIG. 1, designated generally by the reference numeral 10 includes a fuel injector 12 operating alternately on self injection or common rail, both of which include the sub-module for multiple induced injections. The fuel injection system 10 is mounted on an internal combustion engine 14, a portion of which is shown schematically in FIGS. 1 and 2. The internal combustion engine 14 is modified to provide a communication passage 16 with the combustion chamber 18 of the engine 14 to provide the pressure pulse for the self injection feature.

In FIGS. 1 and 2 the alternative utilizing the self injection concept has an actuator module 60 with a spool valve 64 having dimensional differential in its diameter (D2>D1) as indicated. The gas communication passage 16 from the combustion chamber 18 to the gas/hydraulic cylinder 80 provides access to the drive medium to displace a free piston 81. The piston displaces against the return bias of a spring 82 to pressurize the actuator fluid that is filled in the cylinder 80 on the top side of the piston. The actuator fluid is in communication with the hydraulic conduit 40 and the supply port 66.

The supply module 60 of the fuel injector 12 includes a fuel injection cylinder 22 arranged in conjunction with an actuating cylinder 24. A high pressure injector piston 26 is slidable in the fuel injection cylinder 22 against the bias of a compression spring 28. The injector piston 26 has an end 30 coupled to an enlarged amplifier piston 32 that is slidably engaged in the actuating cylinder 24 against the bias of the compression spring 28.

Hydraulic fluid from a hydraulic supply 36 protected by a check valve 38 is fed to the fuel injector 12 through the hydraulic conduit 40. It is to be understood that the fuel injector system of this invention may be utilized in gasoline or diesel engines. In the case of diesel engines, the hydraulic supply is connected to the fuel supply such that the diesel fuel comprises the hydraulic fluid necessary to actuate the injector 12.

The fuel injector body includes a central body (actuating module) 44 housing the necessary hydraulic actuator components and is connected with the high pressure injection module 50 housing the fuel supply components that include a fuel intake port 46 controlled by an electro hydraulic valve 48 that is biased to close by an internal compression spring 53, and opened when attracted by a magnetic plate 51 on the solenoid 52.

Fuel from a fuel source (not shown) is pumped into the injector 12 in a conventional manner during the time of the recharging stroke of the injector piston 26 together with the amplifier piston 24 under the retracting force of the spring 24 and the pressure of the supply source.

During the time of recharging, the injector solenoid 52 is de-energized maintaining the electro hydraulic valve 48 open.

In this time fuel fills the passage 54 in the central body of the injector 12 and the chamber 56 defined by the fuel injection cylinder 22 and the injector piston 26 as it retracts.

On starting of the injection time, the solenoid 52 is energized attracting the magnetic plate 51 which displaces the attached valve 48 to seal the plenum 56 and 54. The starting of injection can be decided by the proper compression pressure for the optimum combustion time based on the indication of the pressure transducer 101 which signals the electronic control module 100 to energize the solenoids 52 and 61, which actuate the electro hydraulic valves 48, 64 of the injector.

Controlling the injection by the real condition of the thermal cycle is the best way to optimize the operational regimes of power and rotation. This is the advantage of a self regulated and optimized injection system.

The effective start of the injection is determined by the action of the supply module 60 upon energizing the solenoid 61 which attracts the magnetic plate 62 against the biased compression spring 63 displacing the spool valve 64. The valve port 65 will be opened giving the incoming hydraulic fluid access to the actuator cylinder through the channel 67. The pressure of the actuating fluid coming from the conduit 40 through the port 66 is equal to the actual pressure in the engine compression chamber at the moment the injection starts. The injection pressure evolution follows the pressure evolution of combustion, preserving by definition the quality of fuel atomization during the time of combustion.

The injection pressure in the actuating cylinder 24 is amplified by a factor of 10 to 15 times in the injection cylinder 22, equivalent to the area ratio of the amplifier piston 32 and injection piston 26.

The end of the injection process is initiated by de-energizing the solenoid 61, which releases the hydraulic spool valve 64. Because of the differential relation ship of the diameters in the spool valve 64, where D2>/D1, the port 65, remains open during the pressure drop in the conduit 40, resulting from the pressure reductions during the expansion time as transmitted by the gas hydraulic piston 80, which is returned to its initial position at the beginning of the compression time by the compression spring 81. In this way all the hydraulic energy accumulated in the actuating system, including the energy in the springs 28 and 81, will be returned back to the engine cycle during expansion.

Simultaneously with de-energizing solenoid 61, solenoid 52 is de-energized which releases the electro hydraulic valve 48, opening the port 46 to the fuel supply (not shown) producing the actual termination of the injection process in a sharp cut-off manner. No shock wave, no pressure oscillation, no post injection release; only a clean injection and clean combustion results from the process.

Figure 1A:
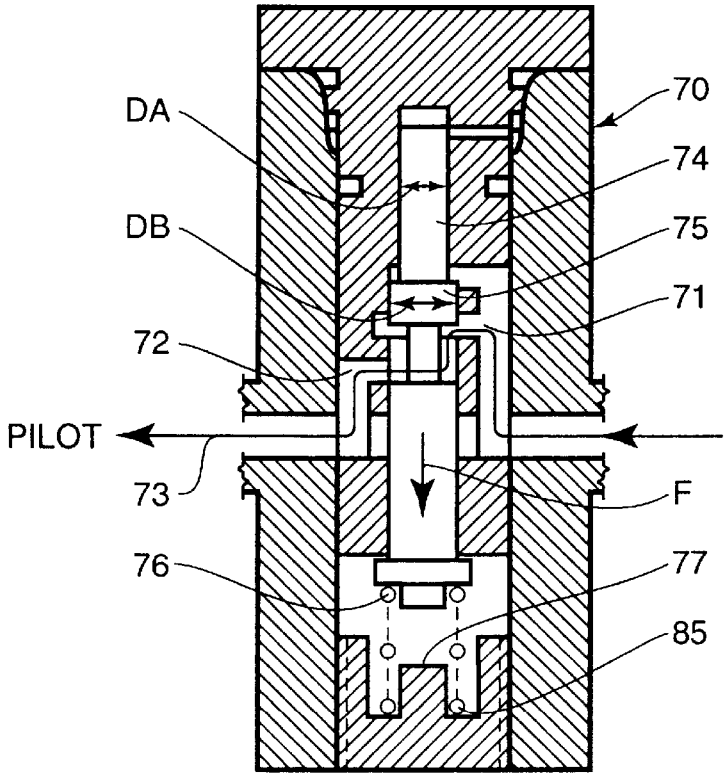
FIG. 1A is an enlarged cross sectional view of sub-module in FIG. 1 for multiple injections in a position of pilot injection.
Figure 1B:
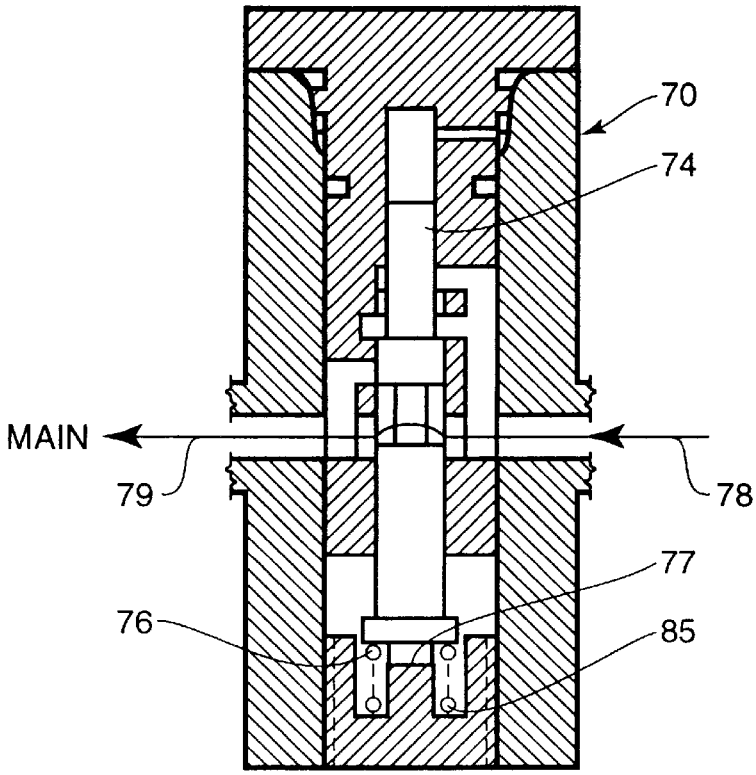
FIG. 1B is a schematic view of the sub-module of FIG. 1A in a position of "main injection".

The sub-module 70 for multiple pulse injection is shown in FIG. 1 and shown enlarged in FIGS. 1A and 1B. Referring to FIG. 1A and 1B, the pressure pulse during injection activates the sub-module 70 enabling the first flow of fuel to pass through a restricted flow area 71 to orifice 72, defined by the position of a control segment 75 of a plunger 74 in relation to an entry port 71. During this time the fuel pressure acts on the differential area defined by the diameters "DB-DA", creating an axial force "F" which moves the plunger 74 against a compression spring 76 until limited by a hydraulic damping well 85 and ultimately a physical stop 77. During this movement the plunger 74 reaches in the position depicted in FIG. 1B, opening the un-restricted, full flow passage 78 to 79 for the main flow of fuel for final injection. From this position, the plunger 74 returns to the pilot position, which in turn triggers a return to the main flow position.

The total stroke of the plunger 74 varies depending on the regime of power and rotation, and the total time of fuel injection, producing one set or multiple sequential sets of injections including the initial pre-injection for delivering a preliminary premixing charge for optimum ignition and control of the combustion process. This results in a dramatic reduction of all pollutants including nox, particulate matter and smoke, and allows multi-fuel capability and eliminates influence of the octane and/or cetane number allowing use of any and all fuels available on the market.

The multiple, sequential, induced injections result from a hydraulic instability of the plunger 74 under the combined action of the evolution of the injection process and the control by the electronic control module (ECM) 100. The purpose and objective of the pulsed injection is to eliminate the compactness of the injection plume and to promote a homogenization of the fuel air mixture during combustion.

Figure 2A:
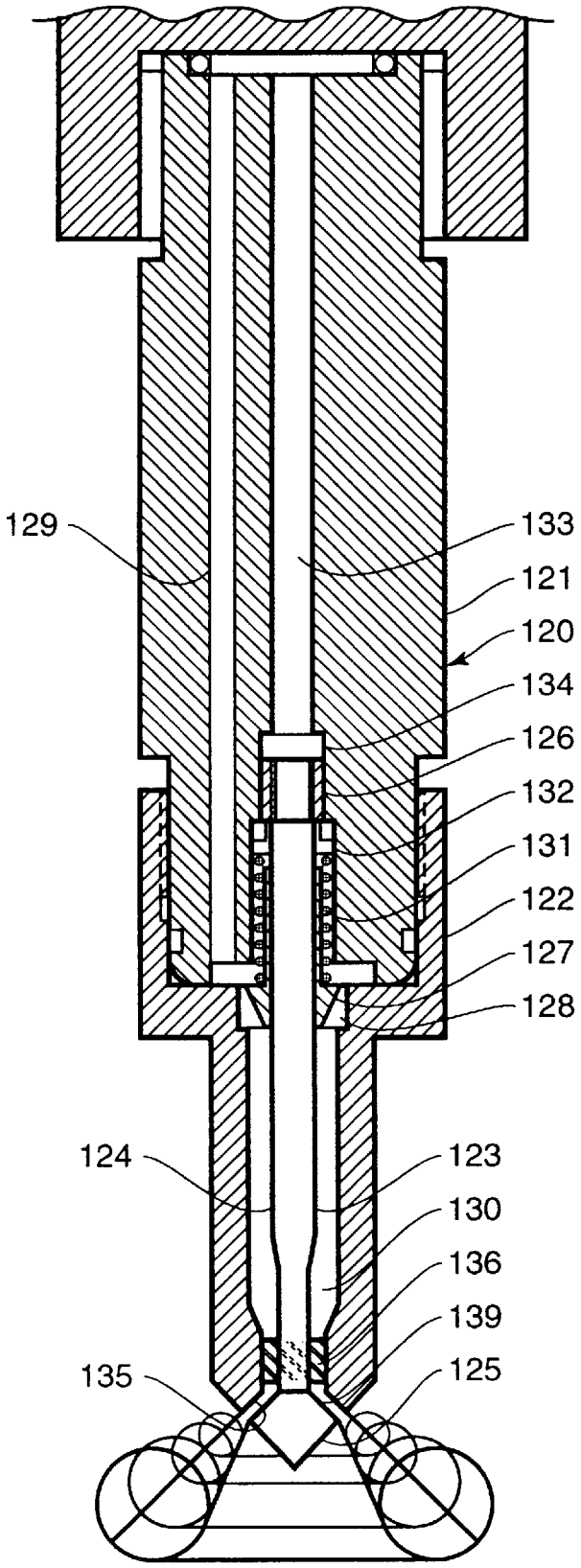
FIG. 2A is an enlarged view of the injector of FIG. 2.

In the embodiment of FIG. 2, the injection system is similar to that of FIG. 1, with the difference that the injector system 10 is provided with an injector 12 having a poppet valve nozzle 120, which is depicted in FIG. 2A.

Referring to the enlarged view of FIG. 2A, the injector nozzle 120 has a main body 121 and a nozzle section 122. The main body 121 connects to the injector module 50 at one end and to the nozzle section 122 at the other end. Within the injector nozzle 120 is a poppet valve 123, with a valve stem 124 having a conical poppet head 125 at one end and an enlarged piston head 126 threaded to the valve stem at the opposite end. The valve stem 124 is displaceable in a stem guide 127 having radial slots 128 to allow fuel to pass from a supply conduit 129 to a nozzle plenum 130. The poppet valve 123 is biased to close by a compression spring 131 seated on the stem guide 127 and retained by a spring retainer 132 fixed to the valve stem 124. The conical poppet value 123 has a conical seating shoulder 139 that seats on a conical poppet seat 135 with the angle of the conical shoulder matching the angle of the conical seat.

Hydraulic actuator fluid (in this instance fuel) contained in a central conduit 133 contacts the piston head 126 in a piston chamber 134 and upon sufficient pressurization displaces the poppet valve as limited by the contact of the retainer 132 with the stem guide 127. When displaced, as shown in FIG. 2A, the poppet head 125 moves from the conical poppet seat 135 allowing fuel to pass from the injector 120, through a uniform flared gap 141. A fluted vortex guide 136 attached to the poppet valve at the end of the nozzle section 122 of the injector imparts a directional rotation to the emitted conical spray.

As centrifuged by the vortex guide 136, the high velocity emitted spray appears to generate over a million rotations of the injected fuel inducing enormous centrifugal dispersing forces on the fuel molecules for total homogenization of the air-fuel mixture.

Because this process is repeated in the preferred pulsed injection system described, the air-fuel mixture can reach its optimum for combustion.

It is to be understood that the preferred embodiments of FIGS. 1 and 2 include the gas/hydraulic module 80 for self induced injection. The injection system can be utilized in a conventional "common rail" hydraulic actuation system using a pressurized actuator fluid (fuel or other system fluid) with certain minor modifications.

The gas hydraulic module 80 is eliminated and replaced by a medium pressure pump 90 to provide pressurized fluid from a reservoir (not shown) to a common rail 95 that supplies the plurality of injectors of a typical multicylinder engine. In this alternate arrangement, the spool valve 64 will be hydraulically balanced, i.e. D1=D2. Where the actuator fluid is fuel, as in the typical common rail system, the actuator module 60 has a fluid connection with the injection module 50 through bypass conduit 91 that connects to the actuator channel 67 through port 93 and to the high pressure delivery conduit 54 through port 94. The bypass conduit 91 is protected from backflow by check valve 92.

The electronic control module 100 controls the injection process based upon a pre-programmed map of optimum performance for the system. The common rail alternative includes the multiple induced injections with a sharp cutoff, but at a constant pressure.

At the start of injection, solenoid 52 is energized thereby sealing the system. An instant later, solenoid 61 is energized opening the spool valve 64, which is hydraulically balanced with D2=D1. The medium pressure actuator fluid acts on the amplifier piston 32, which amplifies the fluid pressure in the piston cylinder 56 under force of the injector piston 26.

The high pressure fuel produces a pilot injection and instantaneously thereafter the main injection as a result of passing through the sub-module 70 as described.

At the end of injection both modules 50 and 60 are de-energized allowing the amplifier piston to return driving the actuator fluid through bypass 91 to charge the cylinder 56, with any excess returning to the fluid source.

Figure 3:
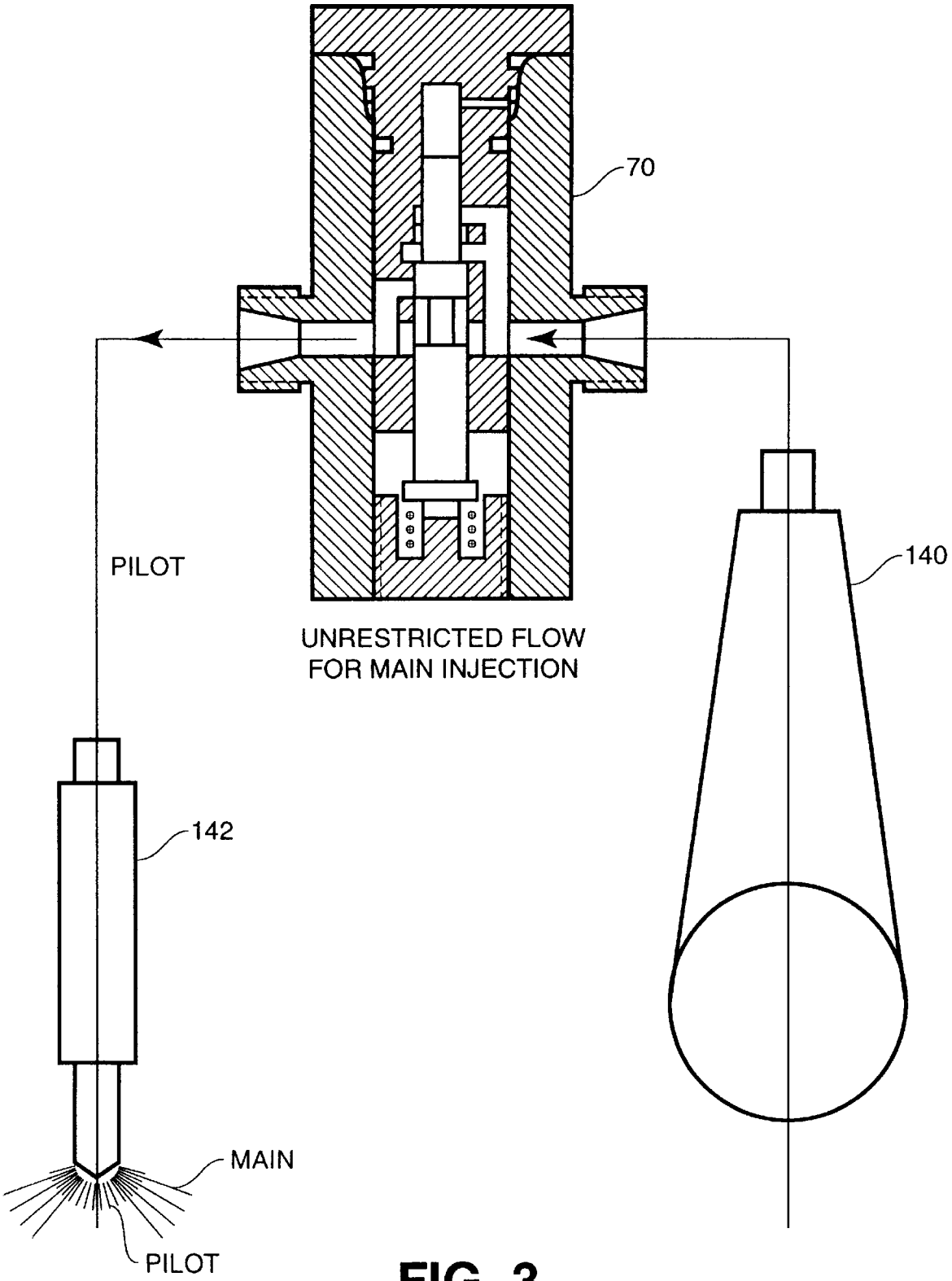
FIG. 3 is a schematic view of a conventional injection system provided with a module for multiple injections in a pilot injection position.

It is also to be understood that the submodule 70 detailed in the cross-sectional views of FIGS. 1A and 1B can be associated with a conventional high pressure fuel pump 140 and injector 142 shown schematically in FIG. 3. In this manner the series of pilot and main injections desired for optimized combustion can be achieved in a modified, conventional injection system to improve combustion and minimize pollution.

Figure 4:
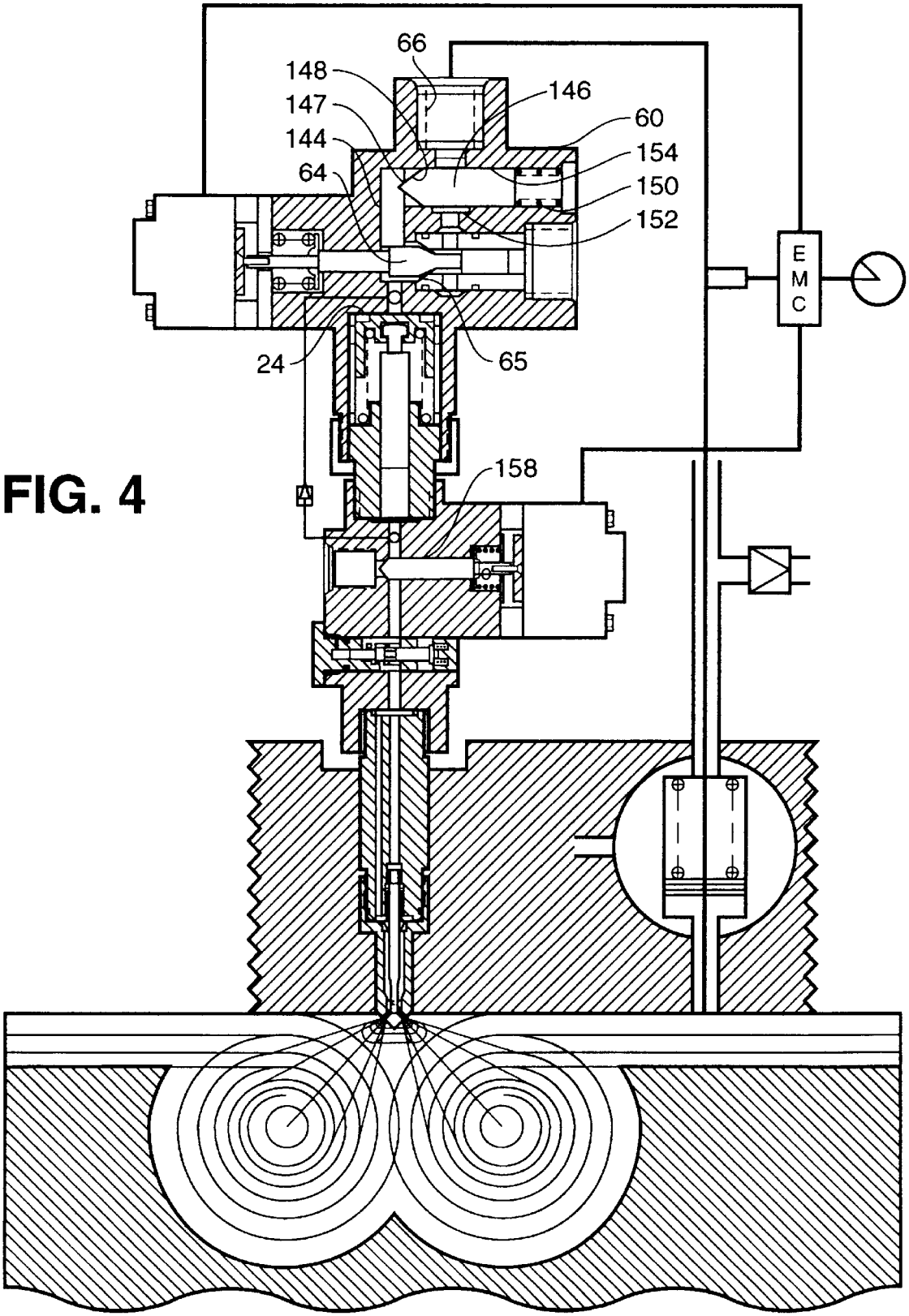
FIG. 4 is a schematic view of an alternate embodiment of the injector system of FIG. 2 provided with a self activated bypass for an increased actuating fluid supply.

Referring to FIG. 4, an alternate embodiment of the injector system is shown. Here the actuator module 60 includes the components as previously described with the addition of a bypass channel 144 protected by a poppet valve 146 with a seating end 147 urged toward the valve orifice 148 by a compression spring 150.

The supply port 66 initially provides access to the valve port 65 through an enlarged section 152 of the poppet valve cylinder 154. When electronically controlled spool valve 64 is opened allowing pressurized actuating fluid to flow to the actuating cylinder 24, then back pressure against the seating end 147 of poppet valve 146 displaces the valve against the spring 150 opening the large orifice 148. The surge of pressurized actuating fluid acts on the amplifier piston 32 to generate a forceful and instantaneous driving pulse for actuating the injection.

To facilitate a rapid cutoff at the end of injection, for the rapid response system utilizing the by-pass slide valve 146, an enlarged cutoff valve 158 is provided to match the high flow system described.

While, in the foregoing, embodiments of the present invention have been set forth in considerable detail for the purposes of making a complete disclosure of the invention, it may be apparent to those of skill in the art that numerous changes may be made in such detail without departing from the spirit and principles of the invention.

What is claimed is:

1. A fuel injection system for an engine having a combustion chamber, the injector system comprising:

a fuel injector with a fuel injection cylinder and a hydraulic actuating cylinder, the injector having an injector piston slidable in the injection cylinder with an enlarged-head, amplifying piston slidable in the hydraulic actuating cylinder, the hydraulic actuating cylinder and amplifying piston defining a hydraulic actuating chamber, the enlarged-head amplifying piston having a diameter substantially greater than the injector piston;

a hydraulic actuating module having a supply of hydraulic fluid with a hydraulic fluid feed conduit connected between the fluid supply and the hydraulic actuating chamber;

activable valve means between the hydraulic fluid feed conduit and the actuating cylinder for selectively communicating the actuating chamber with the feed conduit, wherein the activatable valve means includes an electronically controlled slide valve with control mean, having processing means for processing cycle time and hydraulic pressure in the feed conduit, for selectively activating the valve and communicating the hydraulic fluid in the feed conduit with the actuating chamber at optimal cycle time and pressure; wherein the electronically controlled slide valve has positioning means for maintaining the slide valve in an open position when the pressure of hydraulic fluid in the actuating chamber is greater than the pressure of hydraulic fluid in the feed conduit, wherein the pressurized fluid in the actuating chamber returns energy to the fluid supply; and a hydraulic pulse pump having a pump cylinder with a slide piston dividing the pump cylinder into a first chamber having a passage in communication with the fluid feed conduit and a second chamber having a passage in communication with the combustion chamber wherein during operation the pressure of compression and combustion gases is transmitted to the hydraulic fluid by the hydraulic pulse pump.

2. The fuel injection system of claim 1 wherein the slide valve comprises a spool valve slidable in a valve guide with a central port, the spool valve having first and second end portions with a central enlargement that blocks the port when the valve is closed, wherein the positioning means of the slide valve comprises a dimensional difference in the first end portion relative to the second end portion, the first end portion being located on the fluid supply side of the port and the second end portion being located on the actuating chamber side of the port, wherein the second end portion has an effective diameter greater than the diameter of the first end portion.

3. The fuel injection system of claim 2 wherein the electronically controlled slide valve includes a solenoid wherein the second end portion of the spool valve is connected to the solenoid.

4. The fuel injection system of claim 3 wherein the solenoid includes a compression spring biasing the spool valve to a closed position.

5. The fuel injection system of claim 1 further comprising a fuel supply in communication with the injection cylinder, a nozzle with a fuel discharge orifice, a fuel conduit between the injection cylinder and the discharge orifice, and, multi-pulse generating means communicating with the fuel conduit for automatically producing a multi-pulse fuel discharge at the discharge orifice from a fuel pulse from the injection cylinder on displacement of the injector piston.

6. The fuel injection system of claim 1, further comprising a fuel supply in communication with the injection cylinder, a nozzle with a fuel discharge orifice, and a fuel conduit between the injection cylinder and the discharge orifice, wherein the discharge orifice has a divergent conical opening and wherein the nozzle includes a poppet valve with a poppet head that seats in the conical opening of the discharge opening, the poppet valve having spring bias means for biasing the poppet valve in a closed position in the conical opening.

7. The fuel injection system of claim 6 wherein the poppet valve has a valve stem connected to the poppet head and guide means on the valve stem for imparting a swirl to fuel discharged from the discharge orifice.

8. The fuel injection system of claim 5, further comprising:

a fuel supply in communication with the injection cylinder, a nozzle with a fuel discharge orifice, a fuel conduit between the injection cylinder and the discharge orifice, wherein the discharge orifice has a divergent conical opening and wherein the nozzle includes a poppet valve with a poppet head that seats in the conical opening of the discharge opening, the poppet valve having spring bias means for biasing the poppet valve in a closed position in the conical opening.

9. The fuel injection system of claim 8 wherein:

the poppet valve has a valve stem connected to the poppet head and guide means on the valve stem for imparting a swirl to fuel discharged from the discharge orifice.

10. The fuel injection system of claim 1 wherein the hydraulic actuating module includes a fluid bypass means for delivering an added volume of hydraulic fluid to the actuating chamber on activation of the electronically controlled slide valve.

11. The fuel injection system of claim 10 wherein the fluid bypass means comprises an orifice, and a poppet valve with a sealing end and a compression spring biasing the sealing end of the poppet valve against the orifice, the poppet valve being displaceable against the compression spring to open the orifice by fluid pressure against the sealing end, wherein activation of the electronically controlled slide valve allows hydraulic fluid from the fluid supply to contact the sealing end of the poppet valve and displace the poppet valve from the orifice.

12. In a fuel injector having a fuel input conduit connectable to a high pressure fuel supply, a nozzle having a fuel discharge conduit, a discharge orifice for discharging fuel from the injector, and, a fuel pulse control means for controlling delivery of a pulse of high pressure fuel from the fuel supply to the nozzle, the improvement comprising:

a self-activated, multi-pulse module in the fuel injector between the fuel input conduit and the fuel discharge conduit, the module having a first and second cross passageways connecting the fuel input conduit and the fuel discharge conduit, the valve plunger having first and second cutaway portions selectively alignable with the first and second cross passageways on displacement of the valve plunger in the valve cylinder, a compression spring in the valve cylinder in contact with the valve plunger biasing the valve plunger to a first position wherein the first cutaway portion is aligned with the first cross passageway, wherein pressurized fuel flowing through the first passageway displaces the valve plunger against the compression spring aligning the second cross passageway with the second cutaway portion and blocking flow through the first cross passageway.

13. In a fuel injector having a fuel input conduit connectable to a high pressure fuel supply, a nozzle having a fuel discharge conduit, a discharge orifice for discharging fuel from the injector, and, a fuel pulse control means for controlling delivery of a pulse of high pressure fuel from the fuel supply to the nozzle, the improvement comprising:

a poppet valve controlling discharge of fuel in the fuel discharge conduit to the discharge orifice, the poppet valve having a conical head with a conical seating shoulder and the discharge orifice having a conical poppet seat downstream of said discharge orifice, wherein the conical shoulder has an angle and the conical seat has an angle, and the angle of the conical shoulder matches the angle of the conical seat and, guide means in the discharge conduit of the nozzle for imparting a rotary motion to fuel discharged from the discharge orifice, wherein on displacement of the conical head from the conical seat, a uniform flared gap is formed that generates a conical spray from the discharge orifice that is imparted a rotary motion by the guide means.

14. The improved fuel injector of claim 13, wherein the poppet valve has a valve stem in the discharge conduit and the guide means comprises a fluted vortex structure attached to the valve stem proximate the discharge orifice through which discharging fuel flows.

15. The improved fuel injector of claim 14 wherein the injector includes hydraulic actuator means for timed actuation of the poppet valve.

* * * * *